US008336437B2

(12) United States Patent
Barlow et al.

(10) Patent No.: US 8,336,437 B2
(45) Date of Patent: Dec. 25, 2012

(54) PERFORATING GUN ASSEMBLY AND METHOD FOR CONTROLLING WELLBORE PRESSURE REGIMES DURING PERFORATING

(75) Inventors: Darren Ross Barlow, Houston, TX (US); Cam Van Le, Missouri City, TX (US); James Marshall Barker, Mansfield, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 330 days.

(21) Appl. No.: 12/512,530

(22) Filed: Jul. 30, 2009

(65) Prior Publication Data

US 2011/0000669 A1 Jan. 6, 2011

Related U.S. Application Data

(60) Provisional application No. 61/222,106, filed on Jul. 1, 2009.

(51) Int. Cl.
*E21B 43/117* (2006.01)

(52) U.S. Cl. ..... 89/1.15; 102/310; 102/320; 102/313; 166/55.1; 166/63; 175/4.6

(58) Field of Classification Search ..... 102/306, 102/307, 308, 309, 310, 476, 313, 320; 166/297, 166/299, 55.1, 63, 55, 298; 89/1.15; 175/4.6
See application file for complete search history.

(56) References Cited

U.S. PATENT DOCUMENTS

| | | | |
|---|---|---|---|
| 4,290,486 | A | 9/1981 | Regalbuto |
| 5,098,487 | A | 3/1992 | Brauer et al. |
| 5,295,545 | A | 3/1994 | Passamaneck |
| 5,775,426 | A | 7/1998 | Snider et al. |
| 6,158,511 | A | 12/2000 | Wesson |
| 6,263,283 | B1 | 7/2001 | Snider et al. |
| 6,336,506 | B2 | 1/2002 | Wesson |
| 6,347,673 | B1 | 2/2002 | Dailey |
| 6,378,438 | B1 | 4/2002 | Lussier et al. |
| 6,386,288 | B1 | 5/2002 | Snider et al. |
| 6,446,719 | B2 | 9/2002 | Ringgenberg et al. |
| 6,446,720 | B1 | 9/2002 | Ringgenberg et al. |
| 6,527,052 | B2 | 3/2003 | Ringenberg et al. |

(Continued)

FOREIGN PATENT DOCUMENTS

DE 102005059934 8/2006

(Continued)

OTHER PUBLICATIONS

Atwood, D.C., et al., "Flow Performance of Perforation Tunnels Created with Shaped Charges Using Reactive Liner Technology," Society of Petroleum Engineers (SPE 121931) European Formation Damage Conference, May 2009, The Netherlands.

(Continued)

*Primary Examiner* — James Bergin
(74) *Attorney, Agent, or Firm* — Lawrence R. Youst

(57) ABSTRACT

A perforating gun assembly for use in a wellbore. The perforating gun assembly includes a carrier gun body and a charge holder disposed within the carrier gun body. A plurality of shaped charges are supported within the carrier gun body. A secondary pressure generator is operably associated with at least one of the shaped charges. The secondary pressure generator optimizes the wellbore pressure regime immediately after detonation of the shaped charges by controlling the dynamic underbalance created by the empty gun chambers to prevent excessive dynamic underbalance which may detrimentally effect the perforating operation.

18 Claims, 3 Drawing Sheets

U.S. PATENT DOCUMENTS

| | | | | |
|---|---|---|---|---|
| 6,536,524 | B1 | 3/2003 | Snider | |
| 6,554,081 | B1 | 4/2003 | Brooks et al. | |
| 6,598,682 | B2 | 7/2003 | Johnson et al. | |
| 6,732,798 | B2 | 5/2004 | Johnson et al. | |
| 6,761,219 | B2 | 7/2004 | Snider et al. | |
| 6,874,579 | B2 | 4/2005 | Johnson et al. | |
| 6,896,059 | B2 | 5/2005 | Brooks et al. | |
| 6,966,377 | B2 | 11/2005 | Johnson et al. | |
| 7,011,027 | B2 | 3/2006 | Reese et al. | |
| 7,036,594 | B2 | 5/2006 | Walton et al. | |
| 7,182,138 | B2 | 2/2007 | Behrmann et al. | |
| 7,243,725 | B2 | 7/2007 | George et al. | |
| 7,284,612 | B2 | 10/2007 | Ratanasirigulchai et al. | |
| 7,287,589 | B2 | 10/2007 | Grove et al. | |
| 7,393,423 | B2 | 7/2008 | Liu | |
| 7,428,921 | B2 | 9/2008 | Grove et al. | |
| 7,451,819 | B2 | 11/2008 | Chang et al. | |
| 7,533,722 | B2 | 5/2009 | George et al. | |
| 7,571,768 | B2 | 8/2009 | Cuthill | |
| 7,621,332 | B2 * | 11/2009 | Haney et al. | 166/298 |
| 7,913,761 | B2 | 3/2011 | Pratt et al. | |
| 2003/0131749 | A1 | 7/2003 | Lussier | |
| 2004/0089449 | A1 | 5/2004 | Walton et al. | |
| 2005/0011395 | A1 | 1/2005 | Langan | |
| 2006/0118303 | A1 | 6/2006 | Schultz et al. | |
| 2006/0266551 | A1 * | 11/2006 | Yang et al. | 175/4.6 |
| 2007/0034369 | A1 | 2/2007 | Ratanasirigulchai et al. | |
| 2007/0158109 | A1 | 7/2007 | Zazovsky et al. | |
| 2008/0034951 | A1 * | 2/2008 | Evans et al. | 89/1.15 |
| 2008/0289529 | A1 * | 11/2008 | Schilling | 102/307 |
| 2009/0050321 | A1 | 2/2009 | Rhodes et al. | |
| 2009/0078144 | A1 * | 3/2009 | Behrmann et al. | 102/307 |
| 2009/0078420 | A1 * | 3/2009 | Caminari et al. | 166/297 |
| 2009/0084552 | A1 | 4/2009 | Behrmann et al. | |
| 2009/0183916 | A1 | 7/2009 | Pratt et al. | |
| 2010/0096136 | A1 | 4/2010 | Bourne et al. | |
| 2010/0132945 | A1 * | 6/2010 | Bell et al. | 166/297 |
| 2010/0133005 | A1 * | 6/2010 | Bell et al. | 175/2 |
| 2010/0230104 | A1 * | 9/2010 | Nolke et al. | 166/297 |
| 2011/0000669 | A1 | 1/2011 | Barlow et al. | |
| 2011/0209871 | A1 | 9/2011 | Le et al. | |
| 2011/0219978 | A1 | 9/2011 | Glenn | |

FOREIGN PATENT DOCUMENTS

DE 102005059934 A1 * 8/2006

OTHER PUBLICATIONS

Fischer, S.H., et al., "A Survey of Combustible Metals, Thermites, and Intermetallics for Pyrotechnic Applications," 32nd AIAA/ASME/SAE/ASEE Joint Propulsion Conference, Jul. 1996, Sandia National Laboratories, Albuquerque, NM, US.

Foreign Communication From a Related Counterpart Application—International Search Report and Written Opinion, PCT/US2010/039059, Mar. 30, 2011.

Foreign Communication From a Related Counterpart Application—International Search Report and Written Opinion, PCT/US2011/027638, Sep. 30, 2011.

* cited by examiner

PERFORATING GUN ASSEMBLY AND METHOD FOR CONTROLLING WELLBORE PRESSURE REGIMES DURING PERFORATING

CROSS-REFERENCE TO RELATED APPLICATIONS

This application claims benefit of U.S. Provisional Application No. 61/222,106, filed on Jul. 1, 2009.

TECHNICAL FIELD OF THE INVENTION

This invention relates, in general, to perforating a cased wellbore that traverses a subterranean formation and, in particular, to a perforating gun assembly that is operated to perforate the casing and to control the pressure condition in the wellbore during perforating.

BACKGROUND OF THE INVENTION

Without limiting the scope of the present invention, its background will be described with reference to perforating a subterranean formation using perforating gun, as an example.

After drilling the various sections of a subterranean wellbore that traverses a formation, individual lengths of relatively large diameter metal tubulars are typically secured together to form a casing string that is positioned within the wellbore. This casing string increases the integrity of the wellbore and provides a path for producing fluids from the producing intervals to the surface. Conventionally, the casing string is cemented within the wellbore. To produce fluids into the casing string, hydraulic openings or perforations must be made through the casing string, the cement and a short distance into the formation.

Typically, these perforations are created by detonating a series of shaped charges that are disposed within the casing string and are positioned adjacent to the formation. Specifically, one or more perforating guns are loaded with shaped charges that are connected with a detonator via a detonating cord. The perforating guns are then connected within a tool string that is lowered into the cased wellbore at the end of a tubing string, wireline, slick line, coil tubing or other conveyance. Once the perforating guns are properly positioned in the wellbore such that the shaped charges are adjacent to the formation to be perforated, the shaped charges may be detonated, thereby creating the desired hydraulic openings.

The perforating operation may be conducted in an overbalanced pressure condition, wherein the pressure in the wellbore proximate the perforating interval is greater than the pressure in the formation or in an underbalanced pressure condition, wherein the pressure in the wellbore proximate the perforating interval is less than the pressure in the formation. When perforating occurs in an underbalanced pressure condition, formation fluids flow into the wellbore shortly after the casing is perforated. This inflow is beneficial as perforating generates debris from the perforating guns, the casing and the cement that may otherwise remain in the perforation tunnels and impair the productivity of the formation. As clean perforations are essential to a good perforating job, perforating in an underbalanced condition is preferred. It has been found, however, that due to safety concerns, maintaining an overbalanced pressure condition during most well completion operations is preferred. For example, if the perforating guns were to malfunction and prematurely initiate creating communication paths to a formation, the overbalanced pressure condition will help to prevent any uncontrolled fluid flow to the surface.

To overcome the safety concerns but still obtain the benefits associated with underbalanced perforating, efforts have been made to create a dynamic underbalance condition in the wellbore immediately following charge detonation. The dynamic underbalance is a transient pressure condition in the wellbore during the perforating operation that allows the wellbore to be maintained at an overbalanced pressure condition prior to perforating. The dynamic underbalance condition can be created using hollow carrier type perforating guns, which consists of an outer tubular member that serves as a pressure barrier to separate the explosive train from pressurized wellbore fluids prior to perforating. The interior of the perforating guns contains the shaped charges, the detonating cord and the charge holder tubes. The remaining volume inside the perforating guns consists of air at essentially atmospheric pressure. Upon detonation of the shaped charges, the interior pressure rises to tens of thousands of psi within microseconds. The detonation gases then exit the perforating guns through the holes created by the shaped charge jets and rapidly expand to lower pressure as they are expelled from the perforating guns. The interior of the perforating guns becomes a substantially empty chamber which rapidly fills with the surrounding wellbore fluid. Further, as there is a communication path via the perforation tunnels between the wellbore and reservoir, formation fluids rush from their region of high pressure in the reservoir through the perforation tunnels and into the region of low pressure within the wellbore and the empty perforating guns. All this action takes place within milliseconds of gun detonation.

While creating a dynamic underbalance is beneficial in many circumstances, it has been found that there are some circumstances where excessive dynamic underbalance causes the perforation tunnel to fail due to, for example, sanding. A need has therefore arisen for an apparatus and method for perforating a cased wellbore that create effective perforation tunnels. A need has also arisen for such an apparatus and method that provide for safe installation and operation procedures. Further, a need has arisen for such an apparatus and method that manage wellbore pressure regimes and the dynamic underbalance phenomena.

SUMMARY OF THE INVENTION

The present invention disclosed herein comprises an apparatus and method for perforating a cased wellbore that create effective perforation tunnels. The apparatus and method of the present invention also provide for safe installation and operation procedures as well as for the management of wellbore pressure regimes and the dynamic underbalance phenomena. Further, the apparatus and method of the present invention provide for managing the movement of the gun system and attached pipe or tubing, managing tension and compression in the conveyance tubing and managing the pressure differential applied to packers set in the wellbore above or below the perforating interval.

Broadly stated, the present invention is directed to a downhole tool for use within a wellbore that include a hollow carrier gun body that receives wellbore/formation fluids therein after detonation of a plurality of shaped charges to create a dynamic underbalance pressure condition in the wellbore and a secondary pressure generator disposed within or proximate to the carrier gun body that is used to control the pressure regime in the carrier gun body, the surrounding wellbore or both during the perforating event. This is achieved by predicting and managing the magnitude and the time of the dynamic pressure regime associated with the carrier gun body by introducing a controlled secondary pressure event that counteracts the effect of the empty gun chambers. This secondary event takes place on the order of milliseconds following charge detonation, prior to the creation of the dynamic underbalance condition.

In one aspect, the present invention is directed to a method of determining the pressure that needs to be generated by the secondary pressure generator in the wellbore to offset the dynamic underbalance created by the empty gun chamber using empirical data, software modeling or the like to specifically tailor the perforating gun assembly before deploying to the wellsite.

In another aspect, the present invention is directed to a perforating gun assembly that includes shaped charges that have at least one component that becomes reactive during detonation and serves as the secondary pressure generator. For example, the shaped charge component may be the shaped charge case, the shaped charge liner or the shaped charge explosive. The reaction may manifest itself through either thermal effects, pressure effects or both. In either case, the reaction causes an increase in the pressure within the gun chamber, the near wellbore region or both which counteracts the forces created by the dynamic underbalance condition.

In one embodiment, the shaped charge component may be formed from or may contain a reactive material such as a pyrophoric material, a combustible material, a Mixed Rare Earth (MRE) alloy or the like including, but not limited to, zinc, aluminum, bismuth, tin, calcium, cerium, cesium, hafnium, iridium, lead, lithium, palladium, potassium, sodium, magnesium, titanium, zirconium, cobalt, chromium, iron, nickel, tantalum, depleted uranium, mischmetal or the like or combination, alloys, carbides or hydrides of these materials. In certain embodiments, the shaped charge component may be formed from the above mentioned materials in various powdered metal blends. These powdered metals may also be mixed with oxidizers to form exothermic pyrotechnic compositions, such as thermites. The oxidizers may include, but are not limited to, boron(III) oxide, silicon(IV) oxide, chromium(III) oxide, manganese(IV) oxide, iron(III) oxide, iron(II, III) oxide, copper(II) oxide, lead(II, III, IV) oxide and the like. The thermites may also contain fluorine compounds as additives, such as Teflon. The thermites may include nanothermites in which the reacting constituents are nanoparticles.

In these embodiments, the reactive heat and overpressure caused by the reactive materials counteract the dynamic underbalance condition created by the empty gun chambers. The amount of this counteraction is controlled by the number of shaped charges of the present invention and the ratio of these shaped charges to standard steel case shaped charges, the geometric design of the shaped charges of the present invention, the geometric design of the perforating guns, the composition of the shaped charges and the like.

In one embodiment, the perforating guns are designed with standard steel case shaped charges and shaped charges of the present invention with ratios that can be varied from 1 to 100 up to 100 to 1. In another embodiment, gun carriers loaded with standard steel case shaped charges are assembled with gun carriers loaded with shaped charges of the present invention in gun length ratios that can be varied from 1 to 100 up to 100 to 1.

In a further aspect, the present invention is directed to a perforating gun assembly that includes shaped charges having cases that are surrounded by or are in close proximity to reactive materials. For example, the reactive material may be in the form of a sleeve or a coating disposed on the inner or outer surface of the carrier gun body. In another embodiment, the reactive materials may be nanoparticles that are applied, for example, as a nanolaminate that is disposed on various perforating gun components, such as charge cases, the charge loading tube, the interior or exterior of the carrier gun body or the like. Alternatively or additionally, the reactive materials, in either powder size or nanosize, may be blended into the explosive powder of the shaped charges to generate additional pressure to offset the dynamic underbalance.

In yet another aspect, the present invention is directed to a perforating gun assembly that includes a thermobaric container including one or more of the aforementioned reactive materials that is positioned inside of a carrier gun body or as part of the gun string that generates the desired pressure increase to offset the dynamic underbalance. In one embodiment, the pressure may be released by means of a sleeve or port that opens in response to the detonation of nearby shaped charges or by punch charges that only puncture through the surrounding tubular body but do not create perforation into the wellbore casing.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
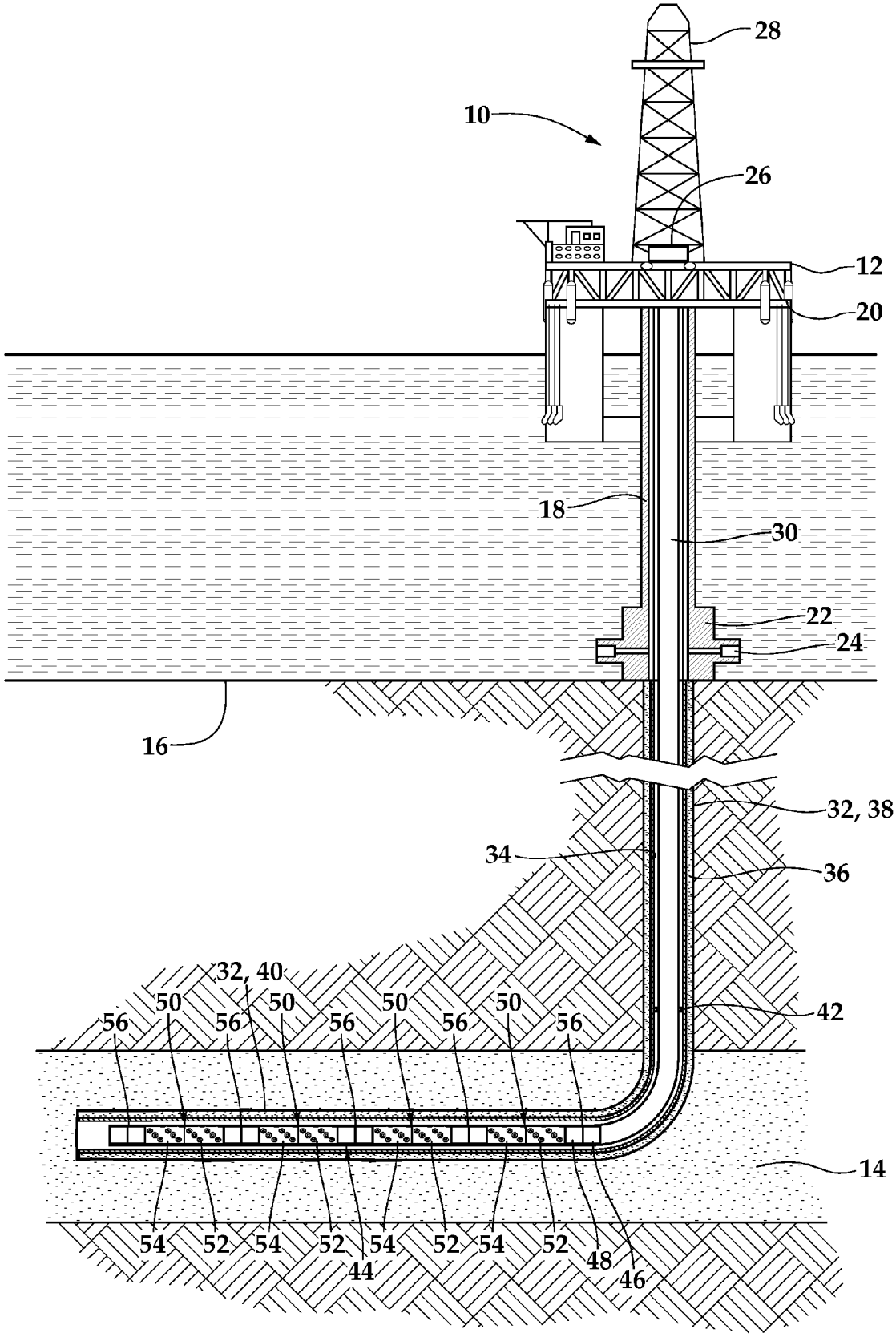
FIG. 1 is a schematic illustration of an offshore oil and gas platform operating a plurality of perforating gun assemblies positioned within a tool string according to an embodiment of the present invention.

Referring initially to FIG. 1, a plurality of perforating gun assemblies of the present invention operating from an offshore oil and gas platform are schematically illustrated and generally designated 10. A semi-submersible platform 12 is centered over a submerged oil and gas formation 14 located below sea floor 16. A subsea conduit 18 extends from deck 20 of platform 12 to wellhead installation 22 including subsea blow-out preventers 24. Platform 12 has a hoisting apparatus 26 and a derrick 28 for raising and lowering pipe strings such as work sting 30.

A wellbore 32 extends through the various earth strata including formation 14. A casing 34 is cemented within wellbore 32 by cement 36. Work string 30 includes various tools such as a plurality of perforating gun assemblies of the present invention. When it is desired to perforate formation 14, work string 30 is lowered through casing 34 until the perforating guns are properly positioned relative to formation 14. Thereafter, the shaped charges within the string of perforating guns are sequentially fired, either in an uphole to downhole or a downhole to uphole direction. Upon detonation, the liners of the shaped charges form jets that create a spaced series of perforations extending outwardly through casing 34, cement 36 and into formation 14, thereby allow formation communication between formation 14 and wellbore 32.

In the illustrated embodiment, wellbore 32 has an initial, generally vertical portion 38 and a lower, generally deviated portion 40 which is illustrated as being horizontal. It should be noted, however, by those skilled in the art that the perforating gun assemblies of the present invention are equally well-suited for use in other well configurations including, but not limited to, inclined wells, wells with restrictions, non-deviated wells and the like.

Work string 30 includes a retrievable packer 42 which may be sealingly engaged with casing 34 in vertical portion 38 of wellbore 32. At the lower end of work string is a gun string, generally designated 44. In the illustrated embodiment, gun string 44 has at its upper or near end a ported nipple 46 below which is a time domain firer 48. Time domain firer 48 is disposed at the upper end of a tandem gun set 50 including first and second guns 52 and 54. In the illustrated embodiment, a plurality of such gun sets 50, each including a first gun 52 and a second gun 54 are utilized. Positioned between each gun set 50 is a blank pipe section 56. Blank pipe sections 56 are used to control and optimize the pressure conditions in wellbore 32 immediately after detonation of the shaped charges. For example, in certain embodiments, blank pipe sections 56 will be used, in addition to the empty gun chambers, to receive a surge of wellbore/formation fluid during the dynamic underbalance pressure condition. In other embodiments, blank pipe sections 56 may serve as secondary pressure generators. For example, blank pipe sections 56 may form thermobaric containers that include reactive material that generates a pressure increase to offset the dynamic underbalance. The reactive material may be in the form of a sleeve or coating on the interior or exterior of blank pipe sections 56 or may be in the form of a component of punch charges that create openings through blank pipe sections 56 but do not perforate casing 34. While tandem gun sets 50 have been described with blank pipe sections 56 therebetween, it should be understood by those skilled in the art that any arrangement of perforating guns may be utilized in conjunction with the present invention including both more or less sections of blank pipe as well as no sections of blank pipe, without departing from the principles of the present invention.

Upon detonation of the shaped charges in perforating guns of gun string 44, there is an initial pressure increase in the gun chambers and near wellbore region created by the detonation gases. Simultaneously with or immediately after the detonation event, the secondary pressure generators of the present invention further increase the pressure within gun chambers, the near wellbore region or both. The secondary pressure generators are utilized to optimize the wellbore pressure regime by controlling the dynamic underbalance created by the empty gun chambers and more specifically, by preventing excessive dynamic underbalance which may detrimentally effect the perforating operation including causing sanding of the newly formed perforations, causing undesirably large movement of the gun system and the attached tubular string, causing high tensile and compressive loads on the conveyance tubing and causing extreme pressure differentials to be applied against previously set packers both above and below the perforating interval.

Figure 2:
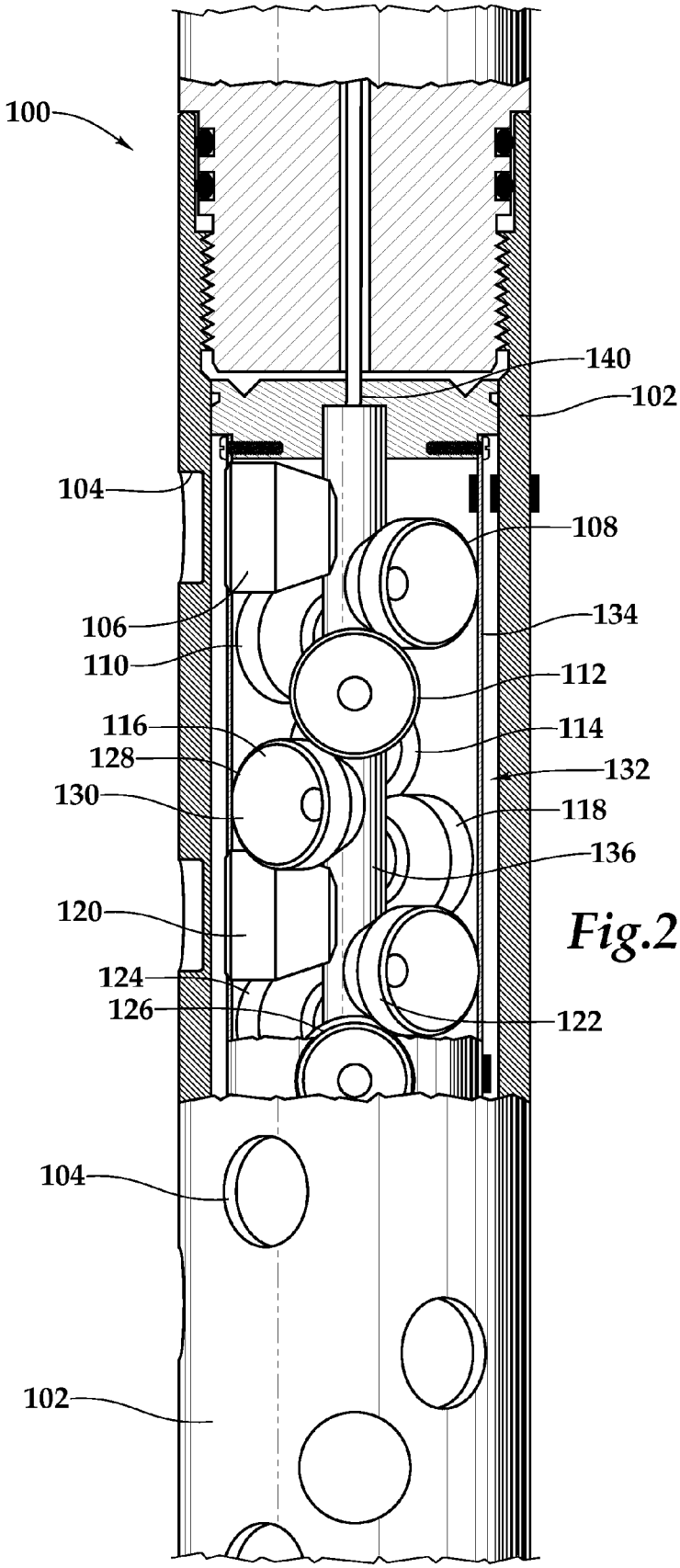
FIG. 2 is partial cut away view of a perforating gun assembly according to an embodiment of the present invention.

Referring now to FIG. 2, therein is depicted a perforating gun assembly of the present invention that is generally designated 100. Perforating gun 100 includes a carrier gun body 102 made of a cylindrical sleeve having a plurality of radially reduced areas depicted as scallops or recesses 104. Radially aligned with each of the recesses 104 is a respective one of a plurality of shaped charges, only eleven of which, shaped charges 106-126, are visible in FIG. 2. Each of the shaped charges, such as shaped charge 116 includes an outer housing, such as housing 128, and a liner, such as liner 130. Disposed between each housing and liner is a quantity of high explosive.

The shaped charges are retained within carrier gun body 102 by a charge holder 132 which includes an outer charge holder sleeve 134 and an inner charge holder sleeve 136. In this configuration, outer tube 134 supports the discharge ends of the shaped charges, while inner tube 136 supports the initiation ends of the shaped charges. Disposed within inner tube 136 is a detonator cord 140, such as a Primacord, which is used to detonate the shaped charges. In the illustrated embodiment, the initiation ends of the shaped charges extend across the central longitudinal axis of perforating gun 100 allowing detonator cord 140 to connect to the high explosive within the shaped charges through an aperture defined at the apex of the housings of the shaped charges.

Each of the shaped charges is longitudinally and radially aligned with one of the recesses 104 in carrier gun body 102 when perforating gun 100 is fully assembled. In the illustrated embodiment, the shaped charges are arranged in a spiral pattern such that each of the shaped charge is disposed on its own level or height and is to be individually detonated so that only one shaped charge is fired at a time. It should be understood by those skilled in the art, however, that alternate arrangements of shaped charges may be used, including cluster type designs wherein more than one shaped charge is at the same level and is detonated at the same time, without departing from the principles of the present invention.

Perforating gun 100 includes a plurality of secondary pressure generators that are formed as a component of or coating on certain of the shaped charges contained therein. In the illustrated embodiment, shaped charges 106, 116 and 126 include the secondary pressure generators. As such, perforating gun 100 has a 4 to 1 ratio of standard shaped charges to shaped charges of the present invention that include secondary pressure generators. Even though a particular ratio has been described and depicted in FIG. 2, those skilled in the art should recognize that other ratios both greater than and less than 4 to 1 are also possible and considered within the scope of the present invention. For example, in certain implementations, a greater ratio such as a 10 to 1 ratio is desirable. In other implementations a 20 to 1 ratio, a 50 to 1 ratio and up to a 100 to 1 ratio may be desirable. Likewise, lesser ratios may also be desirable including, but not limited to, a 1 to 1 ratio, a 1 to 4 ratio, a 1 to 10 ratio, a 1 to 20 ratio, a 1 to 50, a 1 to 100 ratio as well as any other ratio between 100 to 1 and 1 to 100. In addition, in certain embodiments, it may be desirable for all of shaped charges to include secondary pressure generators.

The secondary pressure generators may be formed as all or a part of a charge case such as charge case 128 including as a coating on the charge case, a liner such as liner 130 or the explosive within a shaped charge such as shaped charge 126. Preferably, the secondary pressure generators are formed from a reactive material such as a pyrophoric materials, a combustible material, a Mixed Rare Earth (MRE) alloy or the like including, but not limited to, zinc, aluminum, bismuth, tin, calcium, cerium, cesium, hafnium, iridium, lead, lithium, palladium, potassium, sodium, magnesium, titanium, zirconium, cobalt, chromium, iron, nickel, tantalum, depleted uranium, mischmetal or the like or combination, alloys, carbides or hydrides of these materials. In certain embodiments, the secondary pressure generators may be formed from the above mentioned materials in various powdered metal blends. These powdered metals may also be mixed with oxidizers to form exothermic pyrotechnic compositions, such as thermites. The oxidizers may include, but are not limited to, boron(III) oxide, silicon(IV) oxide, chromium(III) oxide, manganese (IV) oxide, iron(III) oxide, iron(II, III) oxide, copper(II) oxide, lead(II, III, IV) oxide and the like. The thermites may also contain fluorine compounds as additives, such as Teflon. The thermites may include nanothermites in which the reacting constituents are nanoparticles. The reaction generated by the secondary pressure generators may manifest itself through a thermal effect, a pressure effect or both. In either case, the reaction causes an increase in the pressure within perforating gun 100, the near wellbore region or both which counteracts the forces created by the dynamic underbalance condition in the wellbore.

Figure 3:
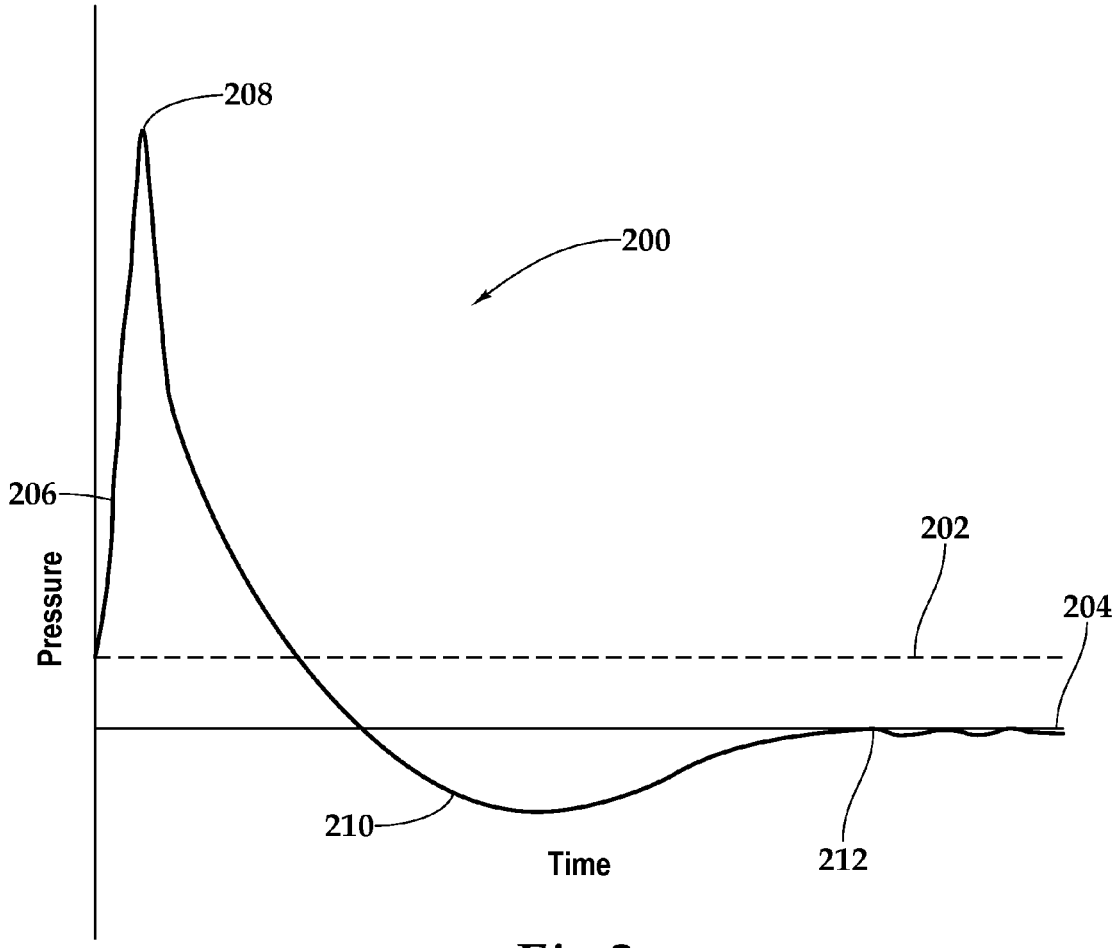
FIG. 3 is a pressure versus time diagram illustrating an average pressure profile in a perforating interval according to an embodiment of the present invention.

Referring now to FIG. 3, a pressure versus timing graph illustrating the average pressure in a perforating interval and generally designated 200. As illustrated, the initial static overbalance pressure condition in the wellbore is depicted as dashed line 202. The static overbalance pressure may be between about 200 psi and about 1000 psi over reservoir pressure, which is indicated at 204. Even though a particular static overbalance pressure range has been described, other static overbalance pressures both greater than 1000 psi and less than 200 psi could also be used with the pressure invention. Likewise, even though a static overbalance pressure is depicted, the present invention could also be used in wellbore having an initial balanced pressure condition or static underbalance pressure condition.

Upon detonation of the shaped charges within the perforating gun or gun string an initial and relatively small dynamic overbalance condition is generated in the near wellbore region that is indicated at 206. Immediately thereafter, the secondary pressure generators of the present invention react to create a secondary pressure event in the form of a relatively large dynamic overbalance condition in the near wellbore region, the peak of which is indicated at 208. In one implementation, the pressure peak of the secondary pressure event occurs within about 100 milliseconds of the detonation of the shaped charges. In another implementation, the pressure peak of the secondary pressure event occurs within about 50 milliseconds of the detonation of the shaped charges. In a further implementation, the pressure peak of the secondary pressure event occurs within about 20 milliseconds of the detonation of the shaped charges. In yet another implementation, the pressure peak of the secondary pressure event occurs within about 10 milliseconds of the detonation of the shaped charges. In an additional implementation, the pressure peak of the secondary pressure event occurs between about 1 millisecond and about 10 milliseconds after the detonation of the shaped charges. In a further implementation, the pressure peak of the secondary pressure event occurs between about 100 microseconds and about 1 millisecond after the detonation of the shaped charges. In another implementation, the pressure peak of the secondary pressure event occurs between about 10 microseconds and about 100 microseconds after the detonation of the shaped charges. The particular implementation to be used is determined based upon empirical data, software modeling or the like and is accomplished using the type and amount of reactive material necessary to achieve a secondary pressure event having the desired pressure profile with a peak pressure at the desired time frame.

The empty volume within the perforating guns and any associated blank pipe then generates a dynamic underbalance condition in the near wellbore region that is indicated at 210. After a short time, the wellbore pressure stabilizes at reservoir pressure as indicated at 212. Importantly, use of the secondary pressure generators of the present invention increases the pressure in the near wellbore region which reduces both the peak and the duration of the dynamic underbalance condition in the near wellbore region, thereby counteracting the forces created by the dynamic underbalance condition in the wellbore and preventing an excessive dynamic underbalance condition in the wellbore.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A perforating gun assembly for use in a wellbore, the perforating gun assembly comprising:

a carrier gun body;

a charge holder disposed within the carrier gun body;

a plurality of shaped charges supported within the carrier gun body by the charge holder; and at least one secondary pressure generator disposed within the carrier gun body, the secondary pressure generator reducing a dynamic underbalanced condition in the wellbore by increasing a pressure condition in the carrier gun body upon activation.

2. The perforating gun assembly as recited in claim 1 wherein the secondary pressure generator further comprises a reactive material.

3. The perforating gun assembly as recited in claim 1 wherein the secondary pressure generator is selected from the group consisting of zinc, aluminum, bismuth, tin, calcium, cerium, cesium, hathium, iridium, lead, lithium, palladium, potassium, sodium, magnesium, titanium, zirconium, cobalt, chromium, iron, nickel, tantalum, depleted uranium and combination, alloys, carbides and hydrides of these materials.

4. The perforating gun assembly as recited in claim 1 wherein the secondary pressure generator further comprises a mixed rare earth alloy.

5. The perforating gun assembly as recited in claim 1 wherein the secondary pressure generator further comprises mischmetal.

6. The perforating gun assembly as recited in claim 1 wherein the secondary pressure generator further comprises a mixture of powdered metals.

7. The perforating gun assembly as recited in claim 1 wherein the secondary pressure generator further comprises thermite.

8. The perforating gun assembly as recited in claim 7 wherein the thermite is selected from the group consisting of boron(III) oxide, silicon(IV) oxide, chromium(III) oxide, manganese(IV) oxide, iron(III) oxide, iron(II, III) oxide, copper(II) oxide, lead(II, III, IV) oxide and combinations thereof.

9. The perforating gun assembly as recited in claim 1 wherein the secondary pressure generator further comprises a fluorine compound.

10. The perforating gun assembly as recited in claim 1 wherein the secondary pressure generator further comprises nanoparticles.

11. The perforating gun assembly as recited in claim 1 wherein the secondary pressure generator is formed as at least a portion of a coating of the carrier gun body, the charge holder, and a thermobaric container positioned within the carrier gun body.

12. The perforating gun assembly as recited in claim 1 wherein the secondary pressure generator further comprises a pyrophoric material.

13. A wellbore pressure control assembly for use during a perforating operation in a wellbore, the wellbore pressure control assembly comprising:

a substantially tubular body;

at least one explosive charge disposed within the tubular body; and at least one secondary pressure generator disposed within the tubular body, the secondary pressure generator including nanoparticles, the secondary pressure generator reducing a dynamic underbalanced condition in the wellbore by increasing a pressure condition in the tubular body upon activation.

14. A wellbore pressure control assembly as recited in claim 13 wherein the at least one explosive charge is one of a shaped charge and a punch charge.

15. The wellbore pressure control assembly as recited in claim 13 wherein the secondary pressure generator further comprises a reactive material.

16. The wellbore pressure control assembly as recited in claim 13 wherein the secondary pressure generator is selected from the group consisting of zinc, aluminum, bismuth, tin, calcium, cerium, cesium, hafnium, iridium, lead, lithium, palladium, potassium, sodium, magnesium, titanium, zirconium, cobalt, chromium, iron, nickel, tantalum, depleted uranium and combination, alloys, carbides and hydrides of these materials.

17. The wellbore pressure control assembly as recited in claim 13 wherein the secondary pressure generator further comprises thermite.

18. The wellbore pressure control assembly as recited in claim 17 wherein the thermite is selected from the group consisting of boron(III) oxide, silicon(IV) oxide, chromium (III) oxide, manganese(IV) oxide, iron(III) oxide, iron(II, III) oxide, copper(II) oxide, lead(II, III, IV) oxide and combinations thereof.

* * * * *